United States Patent [19]

Kamp et al.

[11] 4,227,796

[45] Oct. 14, 1980

[54] ELECTROGRAPHIC APPARATUS HAVING IMPROVED DEVELOPER METERING CONSTRUCTION

[75] Inventors: Dennis R. Kamp, Spencerport; James D. Walling, Fairport, both of N.Y.

[73] Assignee: Eastman Kodak Company, Rochester, N.Y.

[21] Appl. No.: 43,580

[22] Filed: May 29, 1979

[51] Int. Cl.[3] ..... G03G 15/00; G03G 15/09

[52] U.S. Cl. ..... 355/3 DD; 118/656; 118/657; 222/DIG. 1

[58] Field of Search ..... 355/3 R, 3 DD; 222/DIG. 1; 118/653, 656, 657, 658

[56] References Cited

U.S. PATENT DOCUMENTS

| | | | |
|---|---|---|---|
| 2,638,925 | 5/1953 | Monahan | 137/655 |
| 3,724,725 | 4/1973 | Stauffer | 222/DIG. 1 X |
| 3,791,731 | 2/1974 | Mihalik | 355/3 R |
| 3,888,578 | 6/1975 | Eto | 355/3 DD |
| 4,154,520 | 5/1979 | Nishikawa et al. | 355/3 DD |
| 4,163,614 | 8/1979 | Vock | 355/3 DD |

*Primary Examiner*—Fred L. Braun
*Attorney, Agent, or Firm*—John D. Husser

[57] ABSTRACT

Electrographic apparatus having an improved developer metering construction provides an elongated coil spring that extends across an applicator member's transport path (from the developer supply to the development zone) to meter and mix applied developer. Spring tension can be adjusted to control developer flow. In certain embodiments the spring provides a source of reference potential for and/or triboelectrically charges the developer and can enhance magnetic mixing of the developer.

15 Claims, 5 Drawing Figures

FIG. 3
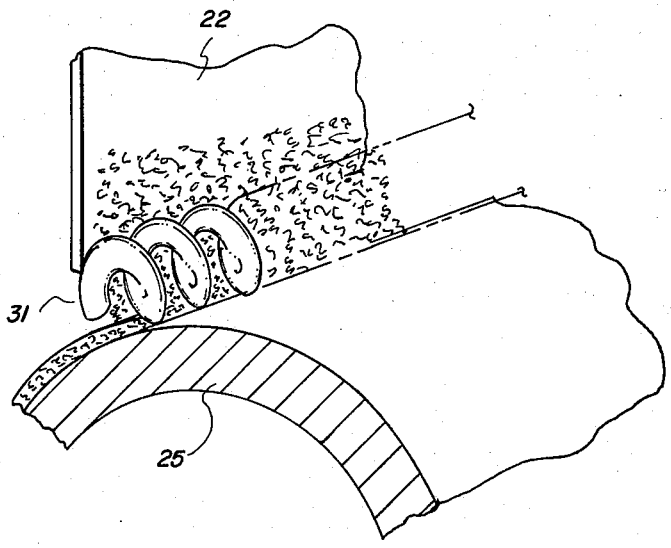
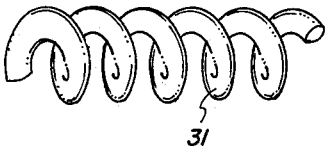
FIG. 4a
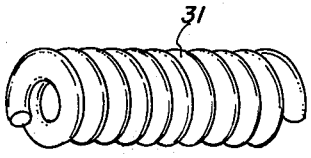
FIG. 4b

ELECTROGRAPHIC APPARATUS HAVING IMPROVED DEVELOPER METERING CONSTRUCTION

BACKGROUND OF THE INVENTION

1. Field of the Invention

The present invention relates to electrographic apparatus and more particularly to such apparatus with an improved construction for controlling the application of particulate developer to an electrographic image member.

2. Description of the Prior Art

In electrographic imaging an image member, bearing an electrical image pattern, is developed by application of marking particles which adhere to the member in accordance with the electrical pattern. Many acceptable techniques exist for applying developer; however, one general approach, which is often used commercially, is to attract particulate developer to an applicator surface and move the applicator into a transfer relation with the image member so that marking particles can adhere to the member in accordance with the image pattern.

Most commonly the applicator is a roller which rotates so that its peripheral surface moves between a developer supply location and a zone in transfer relation with the image member. Adherence of the developer to such applicator rollers can be accomplished in various ways including, e.g., adhesive or electrical attraction, but the most prevalent commercial technique utilizes magnetic attraction and applicators using this technique are often called magnetic brushes. Developers used with such magnetic brushes can be single component (in which case toner is magnetically attractable) or comprise two components (in which case the toner particles are electrostatically attracted to magnetically attractable carrier particles in the developer mixture). The magnetic brush applicators can take various forms; however, a typical configuration comprises a non-magnetic outer cylinder which surrounds an array of magnets located within its inner periphery. Developer transport is effected by rotation of the outer cylinder and/or the interior magnet array.

In using such magnetic brushes (and in other applicators such as mentioned above), the uniformity of image-development often depends significantly upon control of the quantity and density (i.e., compactedness) of developer adhering to the applicator surface. Developer shortage can cause incomplete development and developer excess can cause scratching and other non-uniformities in the developed image. Some development apparatus use conductive or partially-conductive developers to provide an electrically biased development field; and, in such devices, the thickness and degree of compaction of the developer "nap" should be uniform so that predetermined field conditions will exist at the development zone.

The classic technique for controlling nap thickness of such brushes has been a doctor blade that extends across the applicator surface and is spaced a uniform distance from the surface. Such doctor blade is located between the developer supply and the image member so as to skive off excess developer adhering to the roller. Thus, the goal is to position the skiver precisely parallel to the transporting cylinder to form a predetermined gap which controls the amount or thickness of toner passing to the development zone. Although proper skiver positioning is critical, it is extremely difficult to achieve and maintain. An expensive mechanism is necessary if easy adjustment is needed. More often, compromises are made which make such skivers difficult to adjust or not adjustable at all. In addition to the foregoing problems such skivers, or doctor blades, necessarily cause unwanted compaction of the adhered developer, prior to its entering the development zone.

SUMMARY OF THE INVENTION

The present invention pertains to improvements in the electrographic development functions discussed above and it is a primary object of the invention to provide improved control of the developer transported by such applicator members.

In one general aspect the present invention provides, in electrographic apparatus of the kind in which an applicator member transports successive quantities of developer along a transport path from a supply into transfer relation with an image member, an improved construction that controls developer flow during such transport and which comprises elongated spring means extending across such transport path and means for tensioning said spring means to provide for controlled passage therethrough of predetermined volumes of developer. By means of this improved construction, the flow of developer can be simply and accurately metered so that nap thickness and density are maintained within desired parameters. In accordance with additional aspects of the present invention the spring means can be electrically-biased to effectively provide reference for the developer at a desired potential level and the spring means can be constructed to enhance the break-up and/or distribution of developer mixture passing therethrough. Other advantageous features of the present invention will be described subsequently in the description of preferred embodiments.

BRIEF DESCRIPTION OF THE DRAWINGS

The subsequent description of preferred embodiments is made in connection with the attached drawings which form a part hereof and in which:

FIG. 3 is a greatly enlarged perspective view of a portion of such development station; and FIGS. 4*a* and 4*b* are front views of spring elements such as shown in FIG. 3 but in different flow control states.

DETAILED DESCRIPTION OF THE PREFERRED EMBODIMENTS

Figure 1:
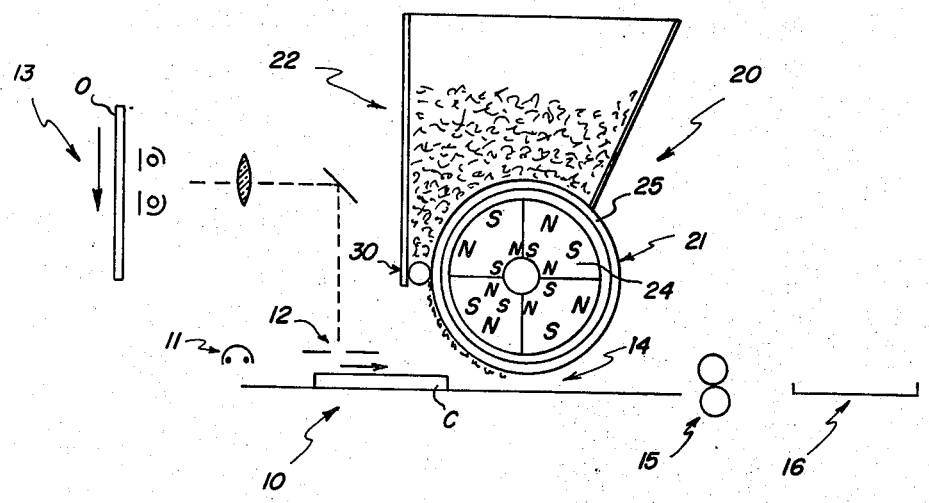
FIG. 1 is a schematic view of electrographic apparatus incorporating one embodiment of the present invention.

FIG. 1 illustrates an exemplary electrophotographic apparatus 10 in which the present invention can advantageously be incorporated. As shown, this apparatus comprises a charging station 11 at which an image member C (e.g., a paper sheet having a photoconductive insulating layer) is subjected to a uniform electrostatic charge (e.g., by a corona discharge electrode). After receiving such a primary charge the image member C passes through an exposure station 12 where the charge-bearing photoconductive surface is exposed to a light image, for example an original O concurrently moved past a scanning station 13. Next, the image member C, now bearing a latent electrostatic image is moved past a development station 14 for application of toner to develop the electrostatic image. Finally the developed sheet passes through station 15 where the toner image is affixed to the sheet, e.g., by pressure and/or heat applied by opposed fixing rollers and the completed copy is fed into a receiving hopper 16.

The development system 20 shown in FIG. 1 comprises a magnetic brush assembly 21 constructed and located to transport successive quantities of developer (e.g,, conductive, magnetic toner particles) from a toner supply 22 into transfer relation with the image member C during its movement past the development station 14. The magnetic brush assembly includes an inner cylinder 24 which is rotatable about a longitudinal axis and is formed of contiguous strip sectors of permanent magnetic material. The magnets are magnitized uniformly along their length as indicated by the N, S designations in the drawing. Coaxially mounted around the magnetic cylinder 24 for rotation about a common axis, as shown, is a cylinder 25 which is non-magnetic and has an outer peripheral surface that is electrically insulative. The cylinders are rotated so that developer, attracted into transport relation with the outer cylinder 25, is fed thereby from the reservoir. In accordance with the present invention, improved flow control means 30 are provided between the toner supply 22 and the development zone 14.

Figure 2:
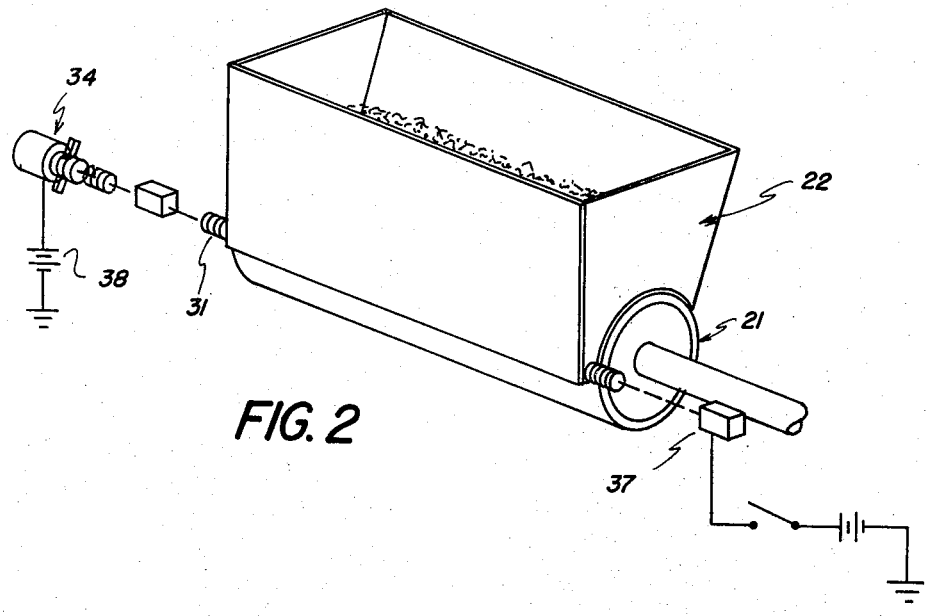
FIG. 2 is an elongated perspective view of the development station shown in FIG. 1.

Referring now to FIGS. 2 and 3, the developer flow control means 30 can be seen in more detail. The central element of the flow control means is an elongated coil expansion spring 31, that extends across the path of the developer that is being fed toward the development zone by the magnetic brush. The wire and coil diameter of the spring can be selected in connection with the characteristics of the particular developer and developer transport system utilized and exemplary parameters will be described below. In general, the design objective is to select a spring that will, within its operable range of extension (i.e., tensioning), provide the appropriate series of equal sized openings (uniformly spaced transversely across the developer transport path) to meter developer to the development zone at the desired rate. This selection can be calculated to an approximate specification and thereafter, a final adjustment, for obtaining the precisely desired flow rate more can be made by fine adjustment of the tensioning of the spring (e.g., by a threaded extender 34 such as shown in FIG. 2). In this regard FIGS. 4*a* and 4*b* show schematically the characteristic of such a spring 31 respectively in a more tensioned condition (to allow more developer to pass) and a less tensioned condition (to allow less developer, or none, to pass).

We have found the coil spring configuration to be preferred in practice of the present invention; however, other similar elongated spring configurations which form passages that can be varied with longitudinal tensioning can be utilized, e.g., a folded strip spring. We have found that for coil springs it is preferred to have the coil diameter (in an untensioned condition) to be about two times the nap thickness of the magnetic brush, e.g., in the range of about 0.05 to 0.5 inches; however, other sizes may be operable in certain applications. In general the preferred wire sizes are in the range of about 5 to 50 mils; however, sizes outside this range would be operable in certain applications.

The following more specific description of one preferred embodiment will be helpful in illustrating typical parameters useful in the present invention. A tightly coiled steel expansion spring having an untensioned outside diameter of 0.250 inches and having a wire diameter of 0.021 inches was used in apparatus like that shown in FIGS. 1 and 2 with exception that only the inner brush cylinder was rotated. The spring was mounted parallel to the cylinder. When ferromagnetic developer was applied to the fixed cylinder and the magnetic core rotated, the developer was transported radially around the periphery of the cylinder in a direction opposite to the rotation of the core. Several commercial single component magnetic developers, each having approximately 50% ferromagnetic content, were tested, including: 3M MAGNE-DRY TYPE 355; 3M VQC TYPE 371; CLARK COPY DRY TONER; and A B DICK 922600 COPIER TONER. With these commercial developers and with other similar magnetic, single component developers, the following was observed:

(1) when the spring was fully compressed no developer flowed past the spring; (2) when the spring was stretched slightly, a small amount of developer, uniformly distributed over the length of the cylinder, flowed through the openings created by the stretching; and (3) stretching the spring increased the developer flow, accordingly.

Upon reflection it will be realized that the spring control means provided hereby avoids costly adjustment mechanism heretofore required with skive blades. Further, instead of compacting during metering, the spring device actually breaks up developer "clumps", thus providing more uniform density and softer naps.

Referring again to FIG. 2, other useful features which can be incorporated with the present invention are shown. By provision of a tension release 37, which could be a conventional solenoid, developer passage can be stopped at desired times. That is deactivation of such solenoid can effect complete release of the spring tension and thus allow the coils to move to a relaxed, contiguous, blocking condition. Upon reactivation of the solenoid, the spring would again be tensioned at its preset (adjusted) condition. To further enhance uniformity of developer distribution (transversely across the path) and further improve developer break-up, the spring 31 can be mechanically rotated on its longitudinal axis, e.g., by drive means located at 37 in FIG. 2, or vibrated along its longitudinal axis by a suitable transducer.

Additionally useful effects can be accomplished by forming the spring of ferromagnetic material. Firstly, such construction affords a highly desirable means of attaining intimate contact between the spring and shell 25. Further, such a construction introduces additional turbulence in magnetic powders passing the spring coils, because of the magnetic fields induced in the coils by the rotating magnetic cylinder 24.

Another significant feature which can be incorporated with certain applications of the present invention, is the provision of an effective electrical potential reference for electrically-conductive developer. By coupling the coil 31 to a potential source such as 38 in FIG. 2, a highly effective electrical coupling is provided to developer passing through the coil and can extend via the developer into the development zone. In certain applications it may be useful to provide a spring with suitable surface characteristics to triboelectrically charge toner passing therethrough.

The following example demonstrates this feature. Using a magnetic brush and developer supply configuration such as shown in FIGS. 1 and 2, a steel spring having an outside diameter of 0.125 inches and a wire size of 0.014 inches was mounted between the supply and the development zone as shown in those Figures. The spring was isolated electrically from the rest of the apparatus so that a potential could be applied to it, if desired. The outer brush cylinder was made of anodized aluminum, so it was electrically insulating. A means of adjusting the stretch of the spring was provided in order to adjust the flow as described above. Using Clark Copy International Corp. dry toner (magnetic), having a resistivity of $10^4$ Ω-cm, a control test was made. A negatively charged latent electrostatic image on Recordak RE-60 zinc oxide photoconductor was developed with the toner supply and the spring electrode electrically "floating" (i.e., not connected to ground or to a bias supply). This produced an image which was of poor quality because only the fringes of the charge patterns were developed, leaving large solid areas undeveloped, Next, a similar latent image was developed with the spring electrode 31 connected to ground. This produced a high quality reproduction, having good solid area development, and appearing in the same sense as the original (i.e., positive original producing a positive appearing copy). Finally, a positively-charged latent image was developed with a bias applied to the spring electrode. The bias was of the same sign and magnitude as the initial charge on the photoconductor. In this instance the copy produced was again high quality, with good solid areas, but of opposite sense to the original (i.e., a positive original produced a negative copy). A control test was made using the same materials and apparatus with the addition of a strip of conductive copper tape on the development zone of the stationary outer cylinder. This simulated a conductive cylinder. This tape was then biased and a latent image similar to the one above was developed. No significant quality difference could be seen between the two biasing methods. These experiments show the spring electrode to be a useful alternative to using a conductive cylinder for ground or bias connections to conductive toners.

The invention has been described in detail with particular reference to certain preferred embodiments thereof, but it will be understood that variations and modifications can be effected within the spirit and scope of the invention.

What is claimed is:

1. In electrographic apparatus in which an electrographic imaging member is moved past a development zone for development of an electrical image thereon, said apparatus including (1) developer supply means spaced from said development zone and (2) applicator means for transporting successive quantities of developer from said supply means into transfer relation with successive portions of said image member passing said development zone; an improved device for controlling the flow of developer during such transport, said device comprising:

(a) an elongated coil spring having loops disposed along a longitudinal axis that extends across the path on which developer is transported from said supply means to said development zone; and (b) means for distending said spring along said longitudinal axis to provide passages therethrough for predetermined volumes of developer.

2. The invention defined in claim 1 wherein said applicator is a magnetic brush and said spring is ferromagnetic thereby enhancing contact between said brush surface and said spring.

3. The invention defined in claim 1 further including means for adjusting the extent of distension of said spring to regulate the developer passages provided thereby.

4. The invention defined in claim 3 further including release means, actuatable independently of said adjusting means, for undistending said spring to substantially close said developer passages.

5. The invention defined in claim 1 further including a source of reference potential coupled to said spring.

6. The invention defined in claim 1 wherein said applicator is a magnetic brush including rotatable magnets and said spring is ferromagnetic whereby developer metered by said spring is magnetically mixed during movement through said passages.

7. The invention defined in claim 1 wherein said spring is rotatable around its longitudinal axis and further including means for so rotating said spring to provide enhanced mixing and more uniform transverse distribution of developer passing therethrough.

8. The invention defined in claim 1 further including means for vibrating said spring to enhance distribution and mixing of developer during movement through said passages.

9. In an electrographic device of the type wherein an imaging member is moved past a development zone for image development, improved image development apparatus comprising:

(a) developer supply means spaced from said development zone;

(b) applicator means for transporting successive quantities of developer, on a external surface thereof, from said supply means to said development zone;

(c) elongated spring means disposed along a longitudinal axis which extends across the path on which developer is transported from said supply means to said development zone and configured to form passages therethrough when stretched along said axis; and (d) means for longitudinally stretching said spring means to provide passages therethrough for predetermined volumes of developer.

10. The invention defined in claim 9 wherein said applicator is a magnetic brush and said spring is ferromagnetic.

11. The invention defined in claim 9 further including means of adjusting the extent which said spring is stretched to vary the size of such developer passages.

12. The invention defined in claim 11 further including actuatable release means, independent of said adjusting means, for disabling said stretching means to prevent developer passage.

13. The invention defined in claim 9 further including a source of reference potential coupled to said spring means.

14. The invention defined in claim 9 wherein said applicator is a magnetic brush including rotatable magnets and said spring means is ferromagnetic so as to provide enhanced magnetic mixing of developer metered by said spring means.

15. The invention defined in claim 9 wherein said spring means is rotatable around its longitudinal axis and further including means for so rotating said spring to provide enhanced mixing and more uniform transverse distribution of developer passing therethrough.

* * * * *